US005944567A

United States Patent [19]

Ratajczak et al.

[11] Patent Number: 5,944,567

[45] Date of Patent: Aug. 31, 1999

[54] HEAT-ACTIVATED WIRE TERMINAL ASSEMBLY AND METHOD

[75] Inventors: Joseph S. Ratajczak, El Paso, Tex.; Danny F. Rockett, Hilliard, Ohio; Harold P. Coyle, El Paso, Tex.

[73] Assignee: Eveready Battery Company, Inc., St. Louis, Mich.

[21] Appl. No.: 08/962,208

[22] Filed: Oct. 31, 1997

[51] Int. Cl.[6] ..... H01R 4/02

[52] U.S. Cl. ..... 439/874; 439/932

[58] Field of Search ..... 439/874, 932

[56] References Cited

U.S. PATENT DOCUMENTS

| | | | |
|---|---|---|---|
| 4,174,563 | 11/1979 | Simpson | 439/932 |
| 4,995,838 | 2/1991 | Ayer et al. | 439/874 |
| 5,163,856 | 11/1992 | McGaffigan et al. | 439/887 |

FOREIGN PATENT DOCUMENTS

| | | | |
|---|---|---|---|
| 2809461 | 9/1978 | Germany | 439/932 |

*Primary Examiner*—Gary F. Paumen

*Attorney, Agent, or Firm*—Linda Gebauer; Robert W. Welsh

[57] ABSTRACT

A wire terminal assembly includes a wire terminal having a cylindrical heat-shrinkable sleeve extending over one end for receiving solder interposed between the terminal and the heat-shrinkable sleeve. The heat-shrinkable sleeve receives an end of a conductor such that heat can be applied to the junction of the terminal, conductor and sleeve to bond the conductor to the terminal and shrink the sleeve over the junction of the conductor and terminal. This invention also contemplates the process of attaching a wire to a terminal by inserting a heat-shrinkable sleeve over a terminal, inserting solder into the sleeve from an end opposite the terminal to surround the terminal, inserting an end of a conductor into the open end of the sleeve and heating the terminal, solder and sleeve to a temperature which melts the solder and shrinks the sleeve onto the junction of the conductor and terminal.

12 Claims, 2 Drawing Sheets

HEAT-ACTIVATED WIRE TERMINAL ASSEMBLY AND METHOD

BACKGROUND OF THE INVENTION

The present invention pertains to a terminal assembly and particularly one which joins a conductor to a terminal for subsequent attachment to a battery or other electrical device.

In order to electrically couple one or more batteries of, for example, a battery pack to a device to be powered by the battery pack, typically wire assemblies are used which include a flat conductive terminal which is spot-welded to the battery. Soldered to the terminal is a wire conductor. The junction of the conductor and terminal typically is sealed using a heat shrinkable insulating sleeve of polyvinyl chloride.

The manufacturing steps, thus, require the wire to be first soldered to the terminal, utilizing conventional soldering techniques, and subsequently a heat-shrinkable tubing placed over the junction of the wire and terminal and heat-shrunk into place providing a water-tight seal for the interface between the wire and terminal. The terminal is subsequently spot-welded to a battery terminal and the conductor extends from the battery and may be terminated in a suitable snap-on lug, depending upon the device to which the battery pack is to be coupled. Preformed heat-shrinkable tubes including solder rings surrounding an end of a terminal fitted to the tubes, which were then heat activated to connect conductors of the terminals, have been employed. However, such a structure requires the manufacture of a particular shape of preformed tube significantly adding to the expense and complexity of the product and manufacturing process.

Such termination of a wire requires multiple steps during manufacturing of preformed heat-shrinkable tubes or terminal assemblies, which require both soldering steps and forming and heat-shrinking of the tubing, typically done at different locations and/or multiple processing stations by different personnel. This is costly due to the time involved, as well as equipment and manpower required to complete the manufacturing.

SUMMARY OF THE PRESENT INVENTION

The heat-activated wire terminal assembly of the present invention overcomes the problems of the prior art by utilizing a heat-shrinkable sleeve which surrounds a terminal to which a wire conductor is to be attached. Solder surrounds the wire and/or terminal prior to the attachment of the conductor which can be soldered directly to the terminal at the same time as the sleeve is heat-shrunk utilizing a conventional heat gun. This eliminates the multiple steps of forming a preformed heat-shrinkable sleeve and or separately soldering and heat-shrinking tubing over a conductor previously soldered to the terminal as in the prior art. Wire terminal assemblies of the present invention, therefore, include a wire terminal having a heat-shrunk sleeve extending therearound for receiving solder interposed between the terminal and the heat-shrinkable sleeve. The heat-shrink sleeve may in the preferred embodiment physically hold a terminal in position therein and be mounted in a fixture which defines a closed end serving to receive solder within the heat-shrinkable sleeve and which surrounds the terminal. Such construction allows the insertion of a stripped end of a conductor and the soldering and, in effect, shrink-wrapping of the conductor to the terminal in a single heating process utilizing a conventional heat gun.

This invention also contemplates the process of attaching a wire to a terminal by inserting a shrinkable sleeve over a terminal, inserting solder into the sleeve, inserting a stripped end of a conductor into an open end of the sleeve and heating the terminal, solder and sleeve to a temperature which melts the solder and shrinks the sleeve onto the junction of the conductor and terminal. Such a method allows the automation of the process of joining the terminal, sleeve and solder and the soldering of the conductor to the terminal. As a result, the cost of manufacturing wire terminal assemblies is reduced as is the speed by which such terminal assemblies can be manufactured.

These and other features, objects and advantages of the present invention will become apparent upon reading the following description thereof together with reference to the accompanying drawings.

DETAILED DESCRIPTION OF THE PREFERRED EMBODIMENT

Figure 1:
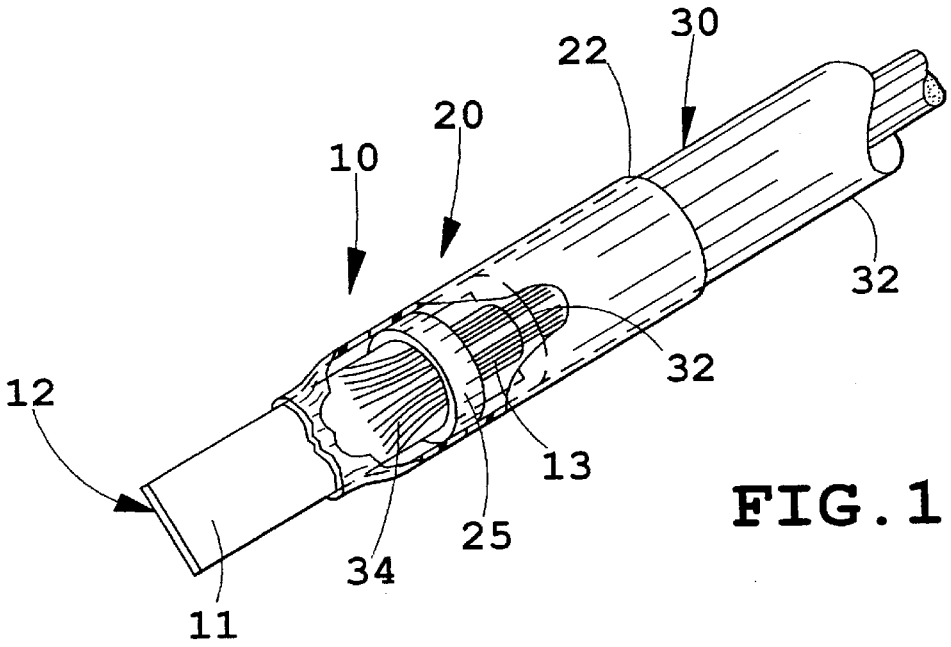
FIG. 1 is a fragmentary, perspective view, partly broken away, of a wire terminal assembly embodying the present invention.
Figure 2:
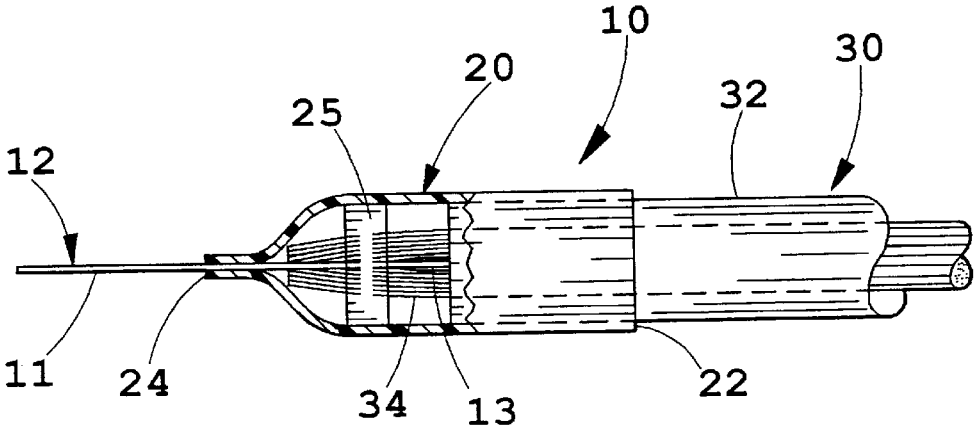
FIG. 2 is a side elevational view of the wire terminal assembly shown in FIG. 1.

Referring initially to FIGS. 1 and 2, there is shown the terminal assembly 10 of the present invention, which includes a flat conductive terminal 12 which can be made of any suitable conductive material such as copper, zinc-plated steel or other conventional conductive material employed for terminals. Although terminal 12 shown in the preferred embodiment comprises an elongated, flat, rectangular terminal with a surface area 11, which is particularly suited for spot-welding the terminal onto a battery contact, terminal 12 may be of a different configuration, such as including apertures, snap-fittings or the like as is conventional. Surrounding an opposite end 13 of the terminal 12 is a heat-shrinkable sleeve 20 made of polyvinyl chloride and which is cylindrical with an initial internal diameter for receiving the flat body of terminal 12. Also, sleeve 20 assists in holding the terminal 12 and a conductor 30 with an insulation layer 32 and braided wires 34 together, as shown in FIGS. 1 and 2. Conductor 30 extends from an end 22 of sleeve 20 and may be terminated in a suitable connector for use in coupling a battery pack to a device powered by the battery pack.

Inserted within the initially (prior to shrinking) open end 22 of the shrinkable sleeve 20 is a solder ring 25, which as described below can be in the form of a ring, having an internal diameter sufficient to encircle the end 13 of terminal 12, which also extends within the shrinkable sleeve 20. The outer diameter of ring 25 is sufficient to fit within the internal diameter of the shrinkable sleeve 20 prior to its heat-shrinking. The sleeve 20 is made of conventional cylindrical heat-shrinkable insulated tubing, such as of PVC, having an internal diameter prior to shrinking which allows the sleeve to fit over the terminal 12 and in physically fixed interrelationship for the subsequent attachment of the wire therein. The solder ring 25 in one embodiment is made of a suitable resin core solder used for electrical applications and is commercially available from a number of sources. Its shape is preferably sleeve-like having a thickness significantly less than its length. The preformed terminal assembly 10 of the present invention, as shown in FIGS. 1 and 2, is manufactured by the process shown in FIGS. 3–7 in which one heating step electrically and mechanically attaches the conductor 30 and the terminal 12.

The completed terminal assembly 10, shown in FIGS. 1 and 2, can be manufactured manually, if desired, by placing a soldering ring 25 over the wire end 34 of the conductor 30 and inserting the wire and solder ring into sleeve 20 from one end and inserting the terminal 12 in the opposite end and subsequently applying heat thereto. Preferably, however, the process is automated in the manufacturing process shown in FIGS. 3–7 now described.

Figure 3:
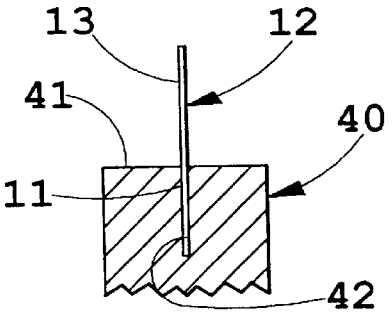
FIGS. 3–7 are schematic views of a method of assembly of the wire terminal assemblies of the present invention.
Figure 4:
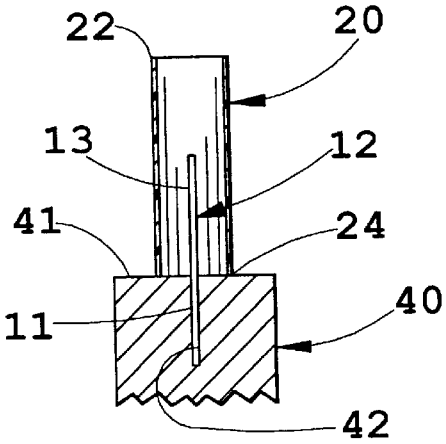

In FIG. 3, there is shown schematically a holder 40 having a generally rectangular slot 42 formed downwardly from the top flat surface 41 thereof, which slot has a depth sufficient to hold one end 11 of terminal 12 therein as shown in FIG. 3, with the terminal 12 being shown in cross section. The interface between the generally flat and rectangular terminal 12 and slot 42 holding fixture 40 should be snug such that, during the manufacturing process, solder cannot enter the area between the terminal 12 and slot 42. Holder 40 has a heat resistance sufficient to resist damage due to heat applied during the manufacturing process and preferably is made of a metal which may be suitably coated to prevent the bonding of solder to the upper surface 41 of the fixture. Subsequent to the insertion of terminal 12 into slot 42, as seen in FIG. 4, one end 24 of a cylindrical heat-shrinkable tube 20 is positioned over terminal 12 with the outer annular edge of end 24 engaging the top surface 41 of fixture 40. The inner diameter of sleeve 20 is selected to snugly engage the opposite end 11 (FIG. 1) of terminal 12 to hold the sleeve in position over the terminal on fixture 40, as seen in FIG. 4. The end 22 of sleeve 20 opposite end 24 extends above the upwardly protruding end of terminal 12 a distance sufficient to, as described in greater detail below, receive not only solder but also the conductor, including the outer insulative layer 32 thereof.

Figure 5:
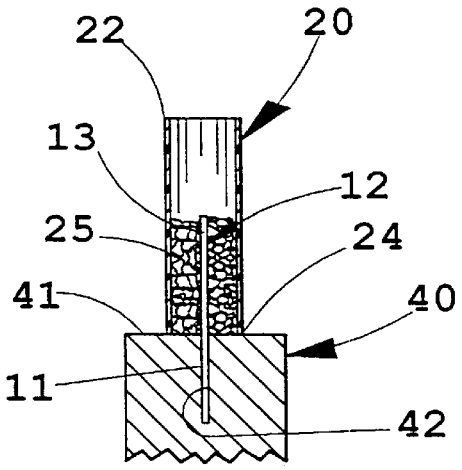

With sleeve 20 now positioned over terminal 12, as seen in FIG. 5, solder 25 is added to the open top 24 of the cylindrical sleeve 20 and is positioned in the space between end 22 of sleeve 20 and the upstanding end 13 of terminal 12. The resin flux solder may take the form of a solder ring, as seen in FIGS. 1 and 2, or can be in the form of small balls, cubes, flakes or the like with a size which allows it to be placed within the sleeve 20 and surrounding the end 13 of terminal 12, as seen in FIG. 5, and yet allow sufficient space for the end 34 of conductor 30 to also be positioned over end 13 of the terminal as shown in the next step of FIG. 6.

Figure 6:
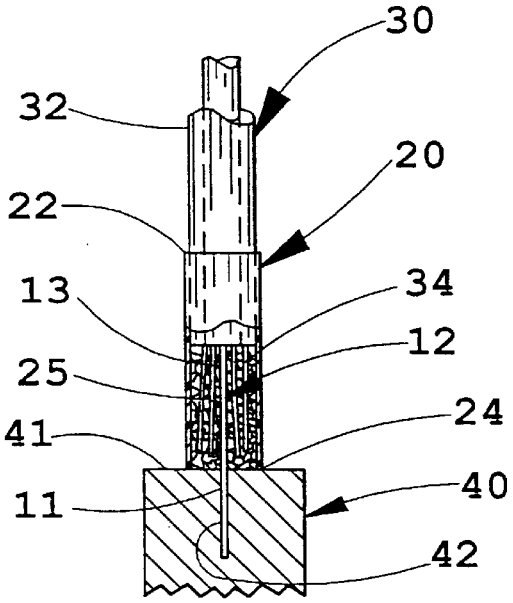

Referring now to FIG. 6, the wire end 34 of conductor 30 is inserted into the open end 22 of sleeve 20 such that the individual wires making up the conductor 30 intermix with the solder 25 and terminal end 13 within sleeve 20. For such purpose, the end 34 of conductor 30 is stripped away sufficiently to allow the conductive braids of the conductor to fully engage upstanding end 13 of terminal 12. Thus, for example, the upstanding end 13 of terminal 12 may extend from ⅜" to ⅝" above surface 41 of holder 40. A similar length of bare conductive wires 34 extend over the end 13 of terminal 12. The heat-shrinkable sleeve 20 engages not only the junction of wire end 34 but also the insulative layer 32 surrounding the conductor 30 to, when shrunk as now described in connection with FIG. 7, electrically and mechanically bind the conductor to the terminal and provide a moisture resistant seal between the conductor 30 and terminal 12.

Figure 7:
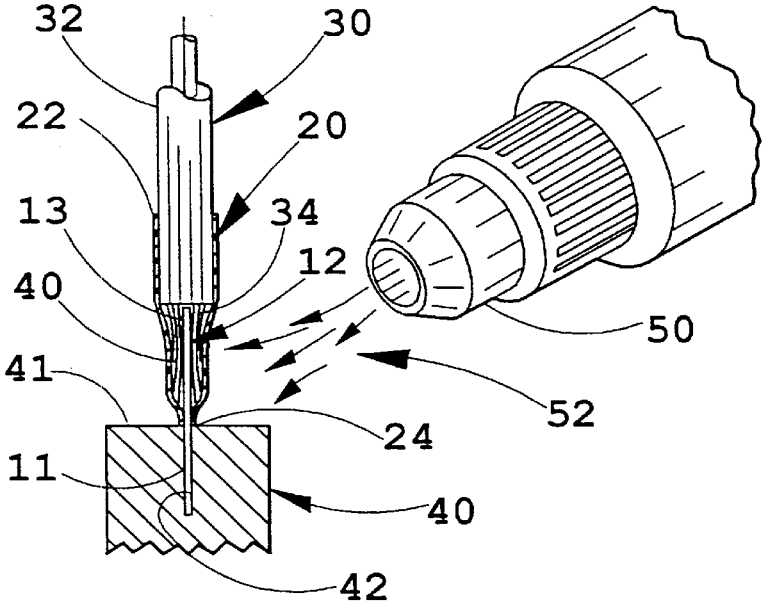

Turning now to FIG. 7, a source of heat such as a heat gun 50 applies by direct convention heat 52 of a sufficient temperature to melt solder 25 as well as simultaneously shrink tube 20 thereby bonding the end 34 of conductor 30 to the end 13 of terminal 12 while sealing this junction with the heat-shrinkable sleeve 20. Upon cooling, the conductor, which now has a completed terminal assembly 10 thereon, is removed from slot 42 of fixture 40 and can be attached to a battery pack or other device.

With the system shown in FIGS. 1–7, therefore, an improved wire terminal assembly and process is provided for attaching a conductor to a terminal for subsequent use in connection with the subsequent attachment of the conductor to other electrical devices such as batteries and the like. The cost of attachment of the conductor to the terminal is greatly reduced, and the reliability of the resultant interconnection is improved.

It will become apparent to those skilled in the art that various sizes of conductors can be employed as well as different terminal and sleeve configurations. These and other modifications to the preferred embodiment of the invention as described herein can be made without departing from the spirit or scope of the invention as defined by the appended claims.

The embodiments of the invention in which an exclusive property or privilege is claimed are defined as follows:

1. A method of attaching a conductor to a terminal comprising the steps of:

inserting a heat-shrinkable sleeve over one end of a terminal;

surrounding the terminal portion extending within said sleeve with granular solder to define a preselected granular solder volume;

inserting a conductor into an end of said sleeve opposite said terminal, said conductor disposed within said granular solder volume; and applying heat to melt said solder and shrink said sleeve onto said terminal and conductor.

2. The method as defined in claim 1 and further including the step of holding said terminal in a generally vertical position to receive and hold said sleeve.

3. The method as defined in claim 2 wherein said holding step includes inserting said terminal in a slot formed in a holder.

4. The method as defined in claim 3 wherein said surrounding step includes inserting said granular solder in an open end of said sleeve for positioning said solder around said terminal.

5. The method as defined in claim 3 wherein said terminal defines spaced apart parallel side edges and further including the step of selecting a sleeve having a cylindrical shape with an inner surface defining a diameter approximately equal to the distance between said spaced apart side edges of said terminal.

6. The method as defined in claim 2 wherein said applying step includes directing heat onto said sleeve for a time sufficient to melt said solder ring and shrink said sleeve.

7. A terminal assembly comprising:

an electrical terminal having a generally flat end defining an end width;

a heat-shrinkable cylindrical sleeve with an inner surface defining an inner diameter about equal to said end width and having one end extending over said end of said terminal to hold said terminal and sleeve together prior to heat-shrinking of said sleeve;

a conductor having an end inserted within an opposite end of said sleeve and extending adjacent said terminal; and solder positioned within said sleeve and surrounding said end of said terminal and said end of said conductor prior to melting of said solder.

8. The terminal assembly as defined in claim 7 wherein said sleeve is made of polyvinyl chloride.

9. The terminal assembly as defined in claim 8 wherein said solder is in the shape of a ring prior to melting.

10. The terminal assembly as defined in claim 9 wherein said solder ring is made of a resin flux solder.

11. The terminal assembly as defined in claim 10 wherein said solder ring has an outer surface defining a diameter approximately equal to said inner diameter of said heat-shrinkable sleeve to allow said ring to fit within said sleeve with substantially all of said outer surface in abutting contact with said inner surface of said sleeve.

12. The terminal assembly as defined in claim 10 wherein said solder ring has a thickness less than its length.

* * * * *